US009827663B2

(12) United States Patent
Kao

(10) Patent No.: US 9,827,663 B2
(45) Date of Patent: Nov. 28, 2017

(54) HAND TOOL FRAME

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 15/142,515

(22) Filed: Apr. 29, 2016

(65) Prior Publication Data

US 2017/0312910 A1 Nov. 2, 2017

(51) Int. Cl.
*B25H 3/04* (2006.01)

(52) U.S. Cl.
CPC ..... *B25H 3/04* (2013.01)

(58) Field of Classification Search
CPC . B25H 3/14; B25H 3/06; B25H 3/003; B25H 3/04; B25H 3/006; B25H 3/00; A47F 5/0846; A47F 5/0853; A47F 5/0838; A47F 7/0028; B25B 13/56
USPC ..... 211/70.6, 60.1, 94.01, 69, DIG. 1; 206/372, 376, 377, 349, 378, 373, 350, 206/443, 818
See application file for complete search history.

(56) References Cited

U.S. PATENT DOCUMENTS 3,405,809 A * 10/1968 Schatz ..... A47J 47/16 211/87.01
5,316,143 A * 5/1994 Horn ..... B25H 3/06 206/350
6,564,949 B1 * 5/2003 Saathoff ..... B25H 3/006 211/70.6
7,669,723 B2 * 3/2010 Kao ..... B25H 3/04 206/349
7,717,278 B2 * 5/2010 Kao ..... B25H 3/04 206/349
8,152,003 B1 * 4/2012 Kao ..... B25H 3/04 211/70.6
8,302,785 B2 * 11/2012 Kao ..... A47F 5/0846 211/70.6
8,403,155 B1 * 3/2013 Kao ..... B25H 3/04 206/376
8,505,720 B2 * 8/2013 Huang ..... B25H 3/00 206/349
8,813,957 B1 * 8/2014 Kao ..... B25H 3/003 206/378
2007/0017886 A1 * 1/2007 Kao ..... A47F 5/0807 211/94.01
2010/0025562 A1 * 2/2010 Shiao ..... B25H 3/04 248/682
2011/0174752 A1 * 7/2011 Liao ..... A47F 5/0838 211/70.6

(Continued)

*Primary Examiner* — Stanton L Krycinski
*Assistant Examiner* — Hiwot Tefera
(74) *Attorney, Agent, or Firm* — patenttm.us

(57) ABSTRACT

A hand tool frame has a track base and at least one positioning mount. The track base has an elongated seat and two rail tabs. The rail tabs are formed on the elongated seat to define a rail channel between the rail tabs. The at least one positioning mount is slidably mounted on the track base and each has a sliding seat, a holding board, a positioning board, and a positioning bolt. The sliding seat is slidably mounted on the top surfaces of the rail tabs and has a through hole. The holding board protrudes from the sliding seat. The positioning board is slidably mounted in the elongated seat, selectively abuts the bottom surfaces of the rail tabs, and has a threaded hole. The positioning bolt is mounted through the through hole in the sliding seat and is screwed with the threaded hole in the positioning board.

8 Claims, 7 Drawing Sheets

(56) References Cited

U.S. PATENT DOCUMENTS

| | | | | |
|---|---|---|---|---|
| 2012/0111814 | A1* | 5/2012 | Kao | A47F 5/0846 211/70.6 |
| 2012/0138553 | A1* | 6/2012 | Kao | B25H 3/06 211/70.6 |
| 2013/0153521 | A1* | 6/2013 | Kao | B25H 3/04 211/70.6 |
| 2015/0202767 | A1* | 7/2015 | Kao | B25H 3/04 211/70.6 |
| 2015/0336262 | A1* | 11/2015 | Kao | B25H 3/06 206/378 |

* cited by examiner

HAND TOOL FRAME

BACKGROUND OF THE INVENTION

1. Field of the Invention

The present invention relates to a hand tool frame, and more particularly to a hand tool frame that may provide a positioning effect to hand tools that are mounted on the hand tool frame and may provide a stable clamping effect to the hand tools.

2. Description of Related Art

A conventional hand tool frame is used to clamp and store hand tools, and has a track base and multiple positioning mounts. The positioning mounts are slidably mounted on the track base. Accordingly, hand tools such as sleeves, wrenches or screwdrivers may be securely mounted on or clamped between the positioning mounts to store the hand tools on the track base of the conventional hand tool frame.

However, the positioning mounts of the conventional hand tool frame lack engaging structures relative to the track base to hold or clamp the hand tools securely on the track base at specific positions. When the conventional hand tool frame is moved or someone hits the hand tools that are stored on the track base of the conventional hand tool frame, the positions of the hand tools that are mounted on the positioning mounts may be changed, and the hand tools that are clamped between the positioning mounts may be separated from the positioning mounts. Then, the hand tools cannot be securely mounted on the positioning mounts at fixed positions or cannot be securely clamped between the positioning mounts, and a user needs to adjust the positions of the hand tools after moving the conventional hand tool frame, and the hand tools may be separated from the positioning mounts and injure the users.

To overcome the shortcomings, the present invention tends to provide a hand tool frame to mitigate the aforementioned problems.

SUMMARY OF THE INVENTION

The main objective of the invention is to provide a hand tool frame that may provide a positioning effect to hand tools that are mounted on the hand tool frame and may provide a stable clamping effect to the hand tools.

The hand tool frame has a track base and at least one positioning mount. The track base is elongated and has an elongated seat and two rail tabs. The elongated seat has a U-shaped cross section and two ends. The two rail tabs are formed respectively on the two ends of the elongated seat to define a rail channel between the rail tabs. Each rail tab has a top surface and a bottom surface. The at least one positioning mount is slidably mounted on the track base, and each one of the at least one positioning mount has a sliding seat, a holding board, a positioning board, and a positioning bolt. The sliding seat is slidably mounted on the top surfaces of the rail tabs of the track base and has a top and a through hole defined through the sliding seat. The holding board is formed on and protrudes from the top of the sliding seat. The positioning board is slidably mounted in the elongated seat of the track base, selectively abuts the bottom surfaces of the rail tabs, and has a threaded hole defined through the positioning board. The positioning bolt is mounted through the through hole in the sliding seat and is screwed with the threaded hole in the positioning board.

Other objects, advantages and novel features of the invention will become more apparent from the following detailed description when taken in conjunction with the accompanying drawings.

DETAILED DESCRIPTION OF PREFERRED EMBODIMENT

Figure 1:
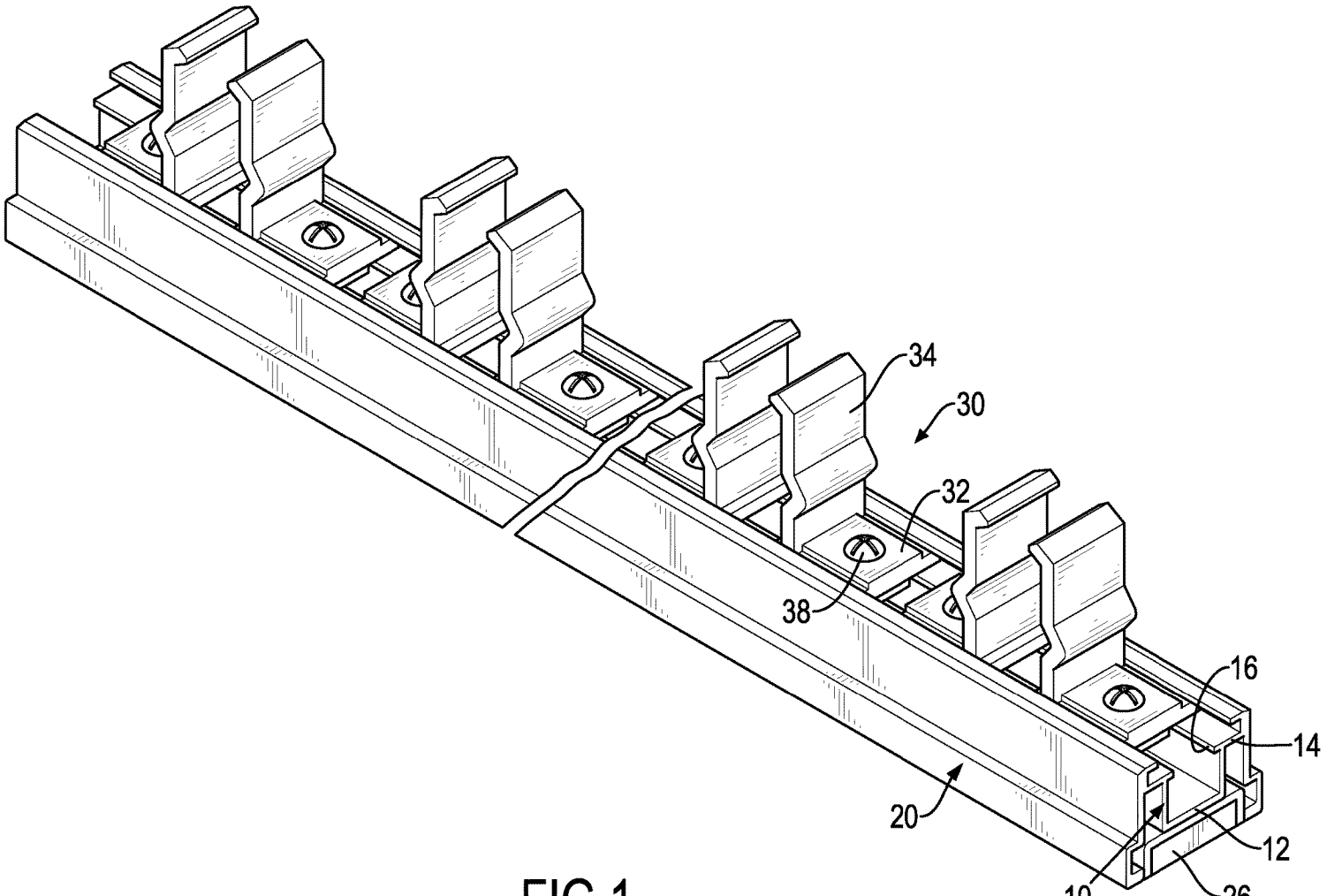
FIG. 1 is a perspective view of a first embodiment of a hand tool frame in accordance with the present invention.

With reference to FIGS. 1 to 4, a first embodiment of a hand tool frame in accordance with the present invention comprises a track base 10 and at least one positioning mount 30.

The track base 10 is elongated and has an elongated seat 12, two rail tabs 14, two outer brackets 20, and at least one magnetic element 26. The elongated seat 12 has a U-shaped cross section and two ends. The two rail tabs 14 are formed respectively on the two ends of the elongated seat 12 to define a rail channel 16 between the rail tabs 14. Each rail tab 14 has a top surface and a bottom surface. The outer brackets 20 are connected respectively with the rail tabs 14. Each outer bracket 20 has a rail flange 22 formed on a top of the outer bracket 20 and extending toward the other outer bracket 20 to define a sliding channel 24 between the rail flange 22 and a corresponding one of the rail tabs 14. The at least one magnetic element 26 is securely mounted on a bottom of the elongated seat 12 and is located between the outer brackets 20. Preferably, each magnetic element 26 is securely mounted on the elongated seat 12 by a bolt and a nut.

The at least one positioning mount 30 is slidably mounted on the track base 10. Preferably, multiple positioning mounts 30 are implemented. Each one of the at least one positioning mount 30 has a sliding seat 32, a holding board 34, a positioning board 36, and a positioning bolt 38. The sliding seat 32 is slidably mounted on the top surfaces of the rail tabs 14 of the track base 10 and has a top and a through hole 322 defined through the sliding seat 32. In addition, the sliding seat 32 may further have two wings 324 formed respectively on two sides of the sliding seat 32 and mounted respectively and slidably in the sliding channels 24 between the outer brackets 20 and the rail tabs 14. The holding board 34 is formed on and protrudes from the sliding seat 32. In the first embodiment, the holding board 34 is bent to define a clamping recess 342 in the holding board 34. The holding board 34 may further have a holding flange 344 formed on a top of the holding board 34 and extending inclinedly toward a direction opposite the sliding seat 32.

The positioning board 36 is slidably mounted in the elongated seat 12 of the track base 10, selectively abuts the bottom surfaces of the rail tabs 14, and has a threaded hole 362 defined in the positioning board 36. The positioning bolt 38 is mounted through the through hole 322 in the sliding seat 32 and is screwed with the threaded hole 362 in the positioning board 36.

Figure 5:
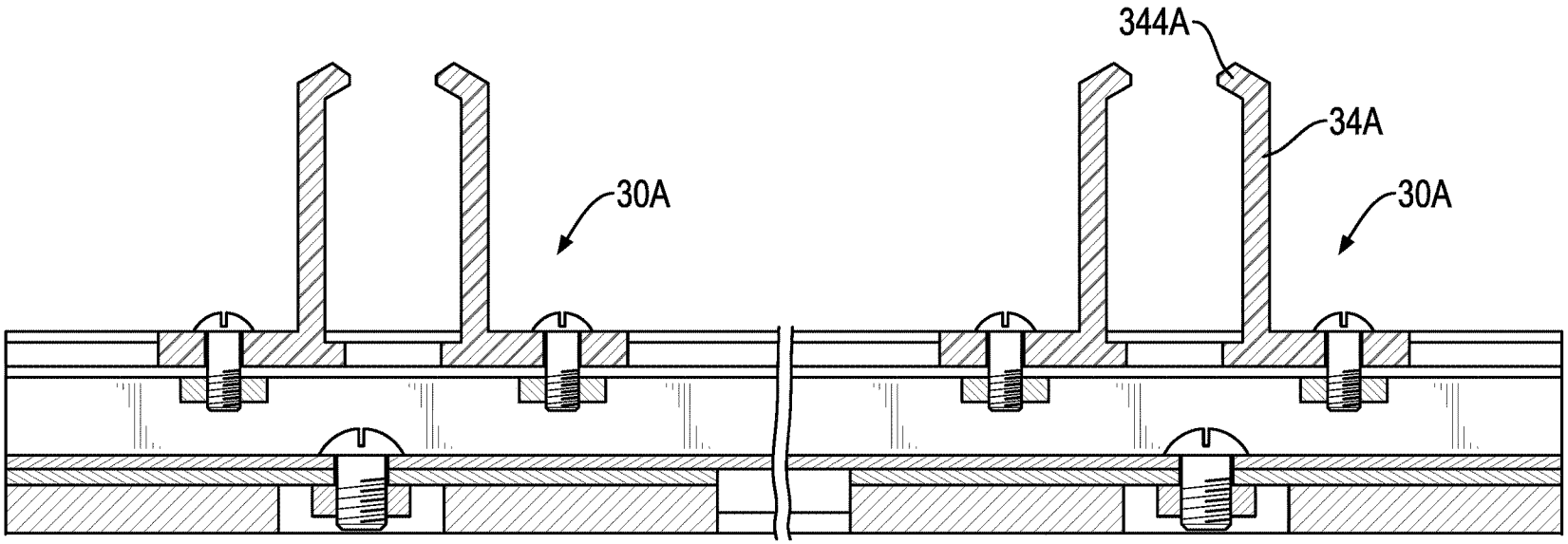
FIG. 5 is a side view in partial section of a second embodiment of a hand tool frame in accordance with the present invention.

With reference to FIG. 5, in the second embodiment, the holding board 34A of each positioning mount 30A may be a flat board and has a holding flange 344A formed on a top of the holding board 34A.

Figure 6:
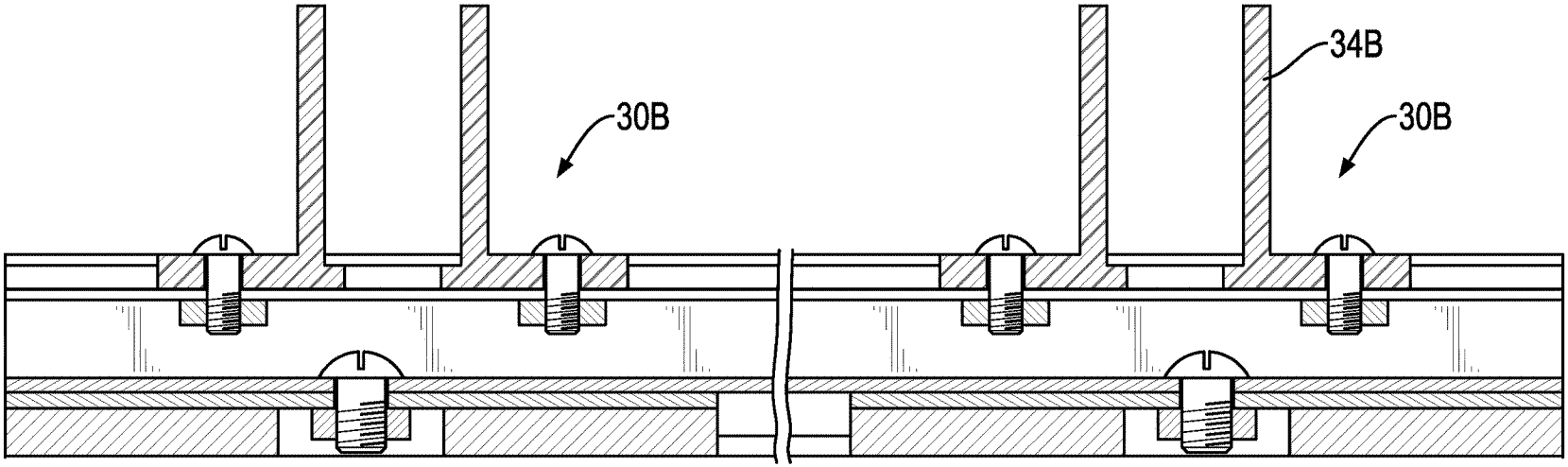
FIG. 6 is a side view in partial section of a third embodiment of a hand tool frame in accordance with the present invention.

With reference to FIG. 6, in the third embodiment, the holding board 34B of each positioning mount 30B may be a flat board.

Figure 2:
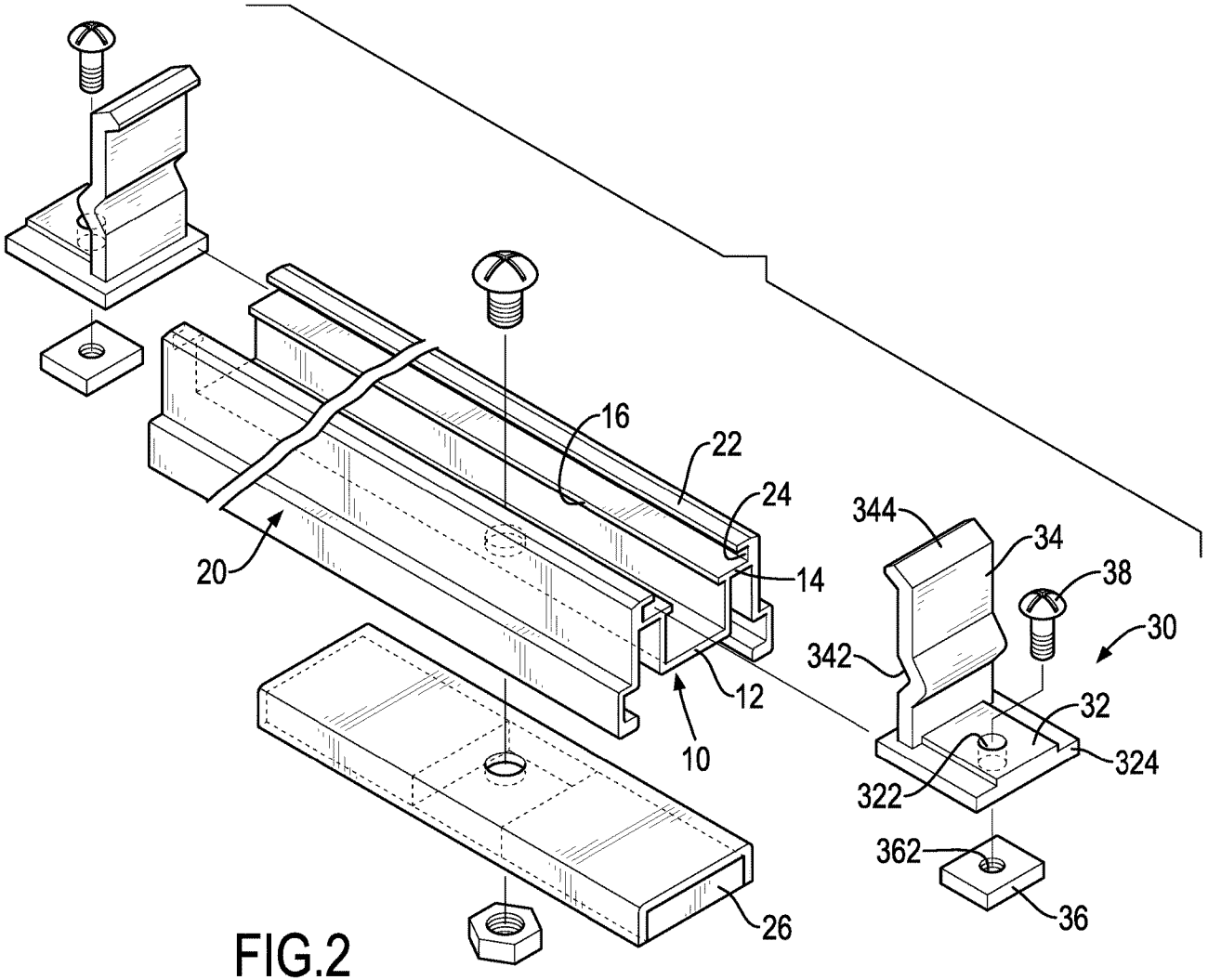
FIG. 2 is an exploded perspective view of the hand tool frame in FIG. 1.
Figure 3:
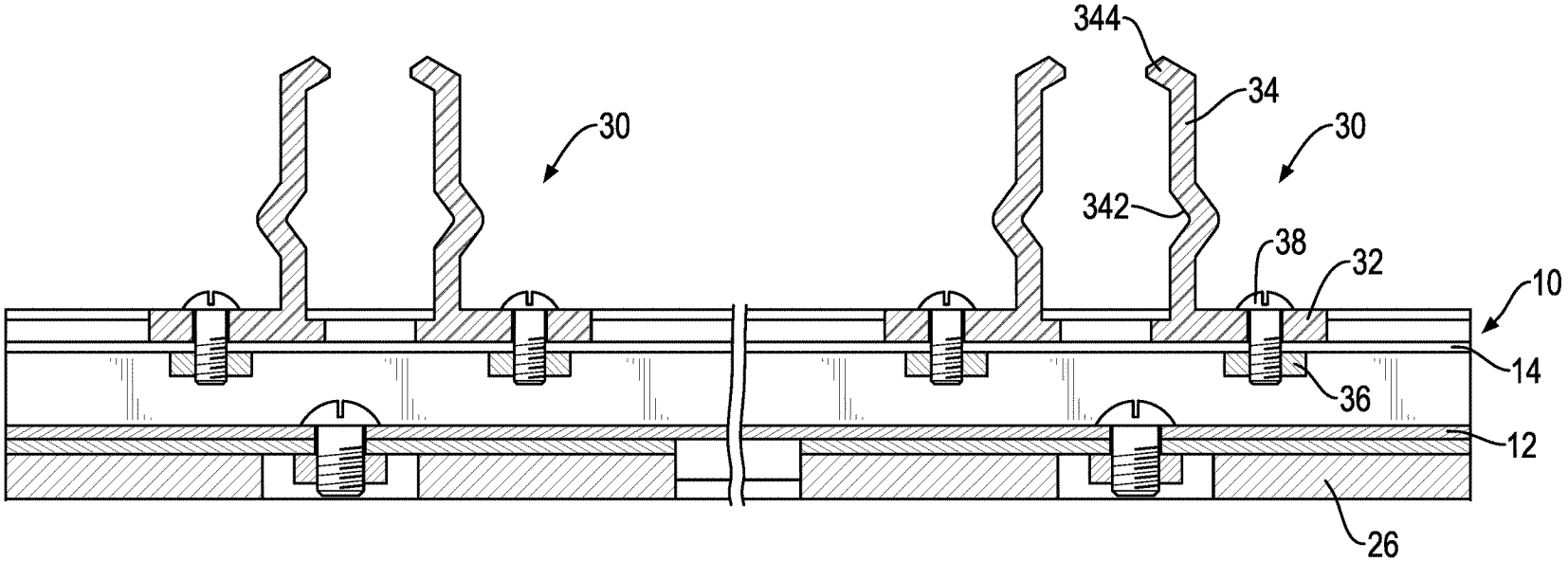
FIG. 3 is a side view in partial section of the hand tool frame in FIG. 1.
Figure 4:
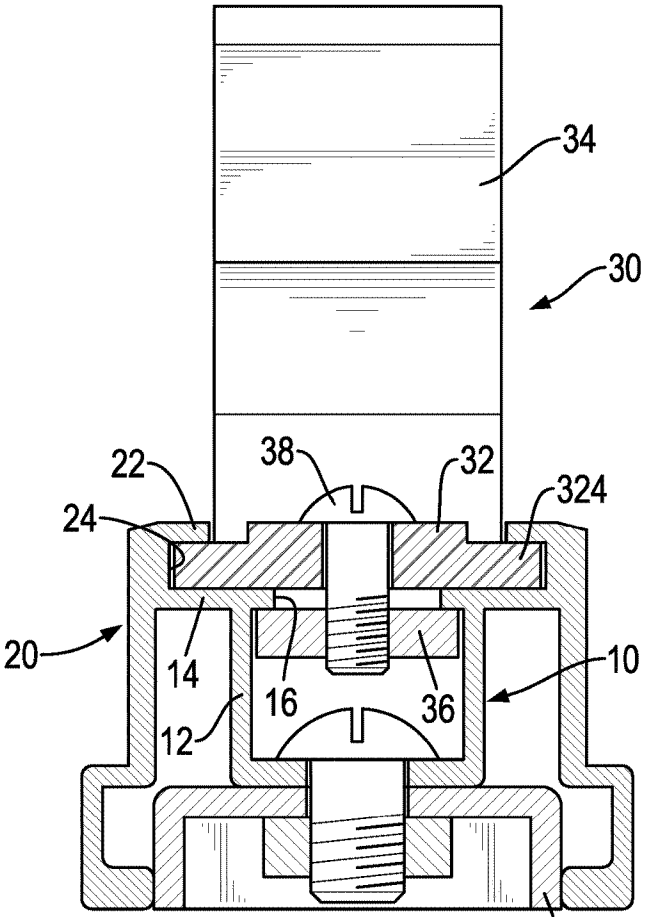
FIG. 4 is an enlarged end view in partial section of the hand tool frame in FIG. 1.
Figure 7:
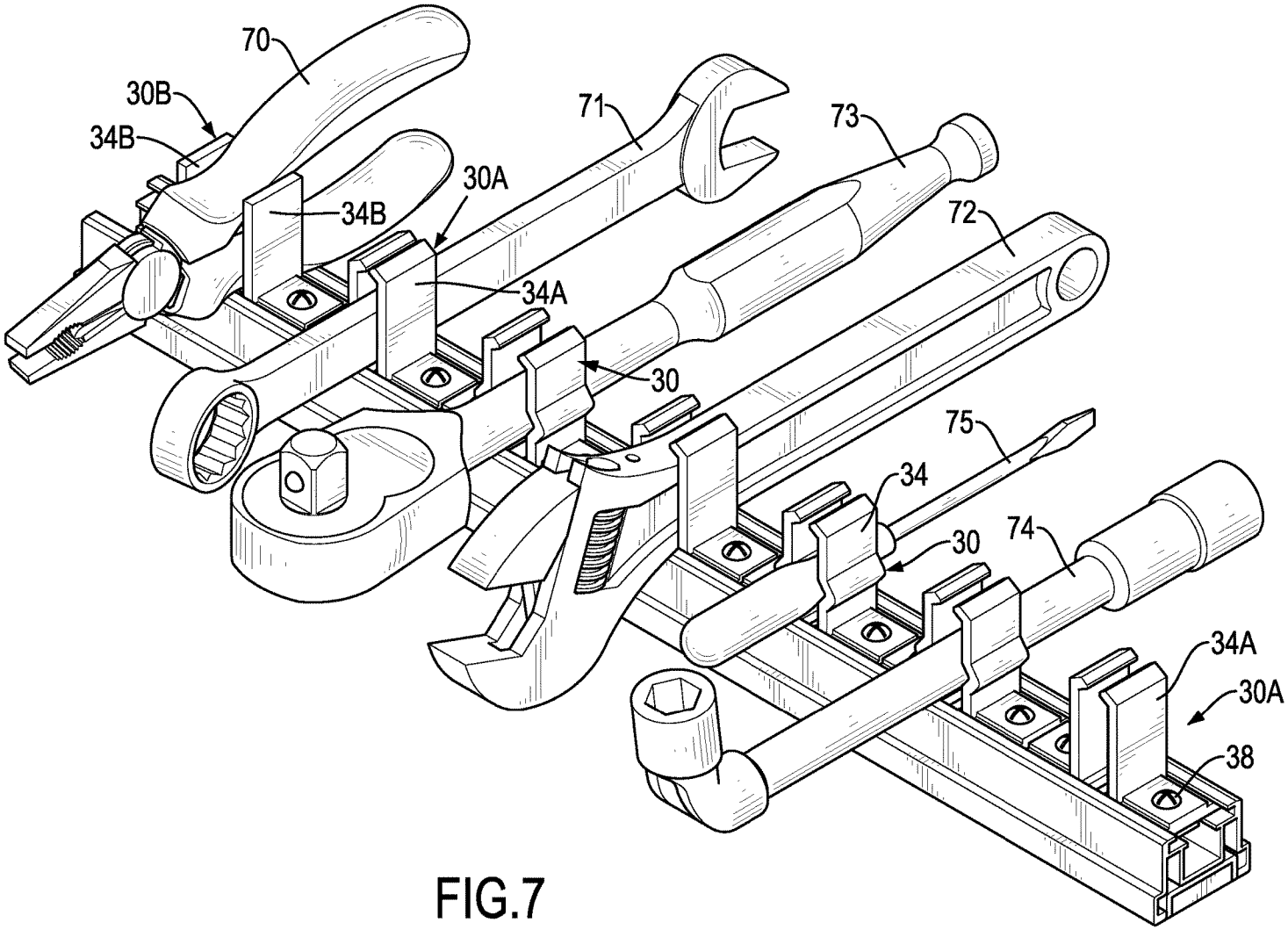
FIG. 7 is an operational perspective view of the hand tool frame in FIG. 1.

With reference to FIGS. 2, 4 and 7, when the hand tool frame in the present invention is in use, the positioning bolts 38 of the positioning mounts 30 are loosened from the threaded holes 362 in the positioning boards 36 to make the positioning boards 36 leave the position where the positioning boards 36 abut the bottom surfaces of the rail tabs 14. Accordingly, the sliding seats 32 of the positioning mounts 30 can be pushed to slide along the rail channel 16 relative to the elongated seat 12. Accordingly, different kinds of hand tools such as pliers 70, combination spanners 71, adjustable wrenches 72, socket wrenches 73, hexagonal wrenches 74 or screwdrivers 75 may be respectively inserted into a holding space that is formed between the holding boards 34,34A, 34B of adjacent positioning mounts 30,30A,30B. Then, the positioning bolts 38 are tightly screwed with the threaded holes 362 in the positioning boards 36 to make the positioning boards 36 abut against the bottom surfaces of the rail tabs 14. Consequently, the hand tools are securely clamped between the holding boards 34,34A,34B of the positioning mounts 30,30A,30B without changing positions or separating from the positioning mounts 30,30A,30B even when a force is applied to the hand tool frame. In addition, the hand tool frame can be attached to an object for holding hand tools in a horizontal or vertical manner, so the hand tool frame is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand tool frame comprising:

a track base being elongated and having an elongated seat having a U-shaped cross section and two ends; and two rail tabs formed respectively on the two ends of the elongated seat to define a rail channel between the rail tabs, and each rail tab having a top surface and a bottom surface; and at least one positioning mount slidably mounted on the track base, and each one of the at least one positioning mount having a sliding seat slidably mounted on the top surfaces of the rail tabs of the track base and having a top and a through hole defined through the sliding seat;

a holding board formed on and protruding from the top of the sliding seat and being perpendicular to the sliding seat to make the positioning mount have an L-shaped cross section;

a positioning board slidably mounted in the elongated seat of the track base, selectively abutting the bottom surfaces of the rail tabs, and having a threaded hole defined in the positioning board; and a positioning bolt mounted through the through hole in the sliding seat and screwed with the threaded hole in the positioning board, wherein the track base further has two outer brackets connected respectively with the rail tabs; and the track base further has at least one magnetic element securely mounted on a bottom of the elongated seat and located between the outer brackets.

2. The hand tool frame as claimed in claim 1, wherein the holding board of each one of the at least one positioning mount is bent to define a clamping recess in the holding board.

3. The hand tool frame as claimed in claim 2, wherein the holding board of each one of the at least one positioning mount has a holding flange formed on a top of the holding board and extending inclinedly toward a direction opposite the sliding seat of the positioning mount.

4. The hand tool frame as claimed in claim 1, wherein the holding board of each one of the at least one positioning mount is a flat board and has a holding flange formed on a top of the holding board and extending inclinedly toward a direction opposite the sliding seat of the positioning mount.

5. A hand tool frame comprising:

a track base being elongated and having an elongated seat having a U-shaped cross section and two ends; and two rail tabs formed respectively on the two ends of the elongated seat to define a rail channel between the rail tabs, and each rail tab having a top surface and a bottom surface; and at least one positioning mount slidably mounted on the track base, and each one of the at least one positioning mount having a sliding seat slidably mounted on the top surfaces of the rail tabs of the track base and having a top and a through hole defined through the sliding seat;

a holding board formed on and protruding from the top of the sliding seat and being perpendicular to the sliding seat to make the positioning mount have an L-shaped cross section;

a positioning board slidably mounted in the elongated seat of the track base, selectively abutting the bottom surfaces of the rail tabs, and having a threaded hole defined in the positioning board; and a positioning bolt mounted through the through hole in the sliding seat and screwed with the threaded hole in the positioning board, wherein the track base further has two outer brackets connected respectively with the rail tabs;

each outer bracket has a rail flange formed on a top of the outer bracket and extending toward the other outer bracket to define a sliding channel between the rail flange and a corresponding one of the rail tabs; and the sliding seat of each one of the at least one positioning mount has two wings formed respectively on two sides of the sliding seat and mounted respectively and slidably in the sliding channels between the outer brackets and the rail tabs; and wherein the track base further has at least one magnetic element securely mounted on a bottom of the elongated seat and located between the outer brackets.

6. The hand tool frame as claimed in claim 5, wherein the holding board of each one of the at least one positioning mount is bent to define a clamping recess in the holding board.

7. The hand tool frame as claimed in claim 6, wherein the holding board of each one of the at least one positioning mount has a holding flange formed on a top of the holding board and extending inclinedly toward a direction opposite the sliding seat of the positioning mount.

8. The hand tool frame as claimed in claim 5, wherein the holding board of each one of the at least one positioning mount is a flat board and has a holding flange formed on a top of the holding board and extending inclinedly toward a direction opposite the sliding seat of the positioning mount.

* * * * *